US007648133B2

(12) United States Patent
Murrell et al.

(10) Patent No.: US 7,648,133 B2
(45) Date of Patent: Jan. 19, 2010

(54) MEDIA SHEET INPUT DEVICES FOR USE IN AN IMAGE FORMING APPARATUS

(75) Inventors: Niko Jay Murrell, Lexington, KY (US); Jason Lee Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 49 days.

(21) Appl. No.: 11/958,669

(22) Filed: Dec. 18, 2007

(65) Prior Publication Data

US 2009/0152797 A1 Jun. 18, 2009

(51) Int. Cl.
*B65H 3/06* (2006.01)

(52) U.S. Cl. ..... 271/117; 271/118

(58) Field of Classification Search ..... 271/117, 271/118

See application file for complete search history.

(56) References Cited

U.S. PATENT DOCUMENTS

| | | | | |
|---|---|---|---|---|
| 5,868,385 | A | 2/1999 | Embry et al. | |
| 6,076,821 | A | 6/2000 | Embry et al. | |
| 7,059,596 | B2 * | 6/2006 | Iwase | 271/114 |
| 7,370,857 | B2 * | 5/2008 | Otsuki | 271/114 |
| 2004/0207145 | A1 * | 10/2004 | Chang | 271/117 |
| 2005/0001371 | A1 * | 1/2005 | Otsuki | 271/113 |

* cited by examiner

*Primary Examiner*—David H Bollinger
(74) *Attorney, Agent, or Firm*—David D. Kalish; William F. Esser

(57) ABSTRACT

Assemblies and methods to move media sheets from a media stack within an image forming apparatus. These may include a pivoting arm with an attached roller that contacts the media stack and rotates to move a top-most sheet from the media stack. A clutch may be operatively connected to the arm for the arm to pivot in a first direction to maintain the roller positioned on a top of the media stack as the media stack is depleted and a height of the media stack is reduced. The clutch may also reduce movement of the arm in a second direction beyond a predetermined amount.

18 Claims, 6 Drawing Sheets

MEDIA SHEET INPUT DEVICES FOR USE IN AN IMAGE FORMING APPARATUS

BACKGROUND

The present application is directed to a media sheet input device to introduce media sheets into a media path within an image forming apparatus and particularly to devices with a clutch to reduce pick variability.

Image forming apparatus' include an input section wherein media sheets are introduced into a media path. The input section may include a variety of constructions, including but not limited to a removable input tray and a shelf sized to position one or more media sheets. A pick arm is pivotally positioned to contact a top-most media sheet in the input section. The pick arm is activated and drives the top-most media sheet from the input section and into the media path. As the top-most media sheet is pulled by the media path, the pick arm may pivot upward away from the remaining media sheets. After the top-most sheet moves out of the input section, the pick arm settles downward and contacts the subsequent top-most media sheet.

One issue with this system is the delay in moving the subsequent sheets from the input section caused by the settling pick arm. The delay includes the time necessary for the pick arm to settle downward and come into contact with the subsequent sheet. In some systems, this delay accounts for as much as sixty percent of the total pick variability. The delay further causes an enlarged interpage gap to be formed between the sheets as they move along the media path. Larger interpage gaps may negatively impact print quality and decrease the life of supply items.

SUMMARY

The present application is directed to assemblies and methods to move media sheets from a media stack within an image forming apparatus. The assemblies may include a pivoting arm with an attached roller that contacts the media stack and rotates to move a top-most sheet from the media stack. A clutch may be operatively connected to the arm for the arm to pivot in a first direction to maintain the roller positioned on a top of the media stack as the media stack is depleted and a height of the media stack is reduced. The clutch may also reduce movement of the arm in a second direction beyond a predetermined amount.

The methods may include contacting the roller on the arm against a top of a media stack and rotating the roller and moving a top-most sheet from the media stack into a media path. As a height of the media stack is depleted, the arm may pivot in a first direction and maintain the roller in contact with the top of the media stack. As the arm pivots in the first direction, a first element of a clutch may slide against a second element of the clutch as the arm pivots in the first direction. When the arm begins to pivot in a second direction away from the media stack, the first element of the clutch may lock with the second element of the clutch and limit the roller from moving away from the top-most sheet.

DETAILED DESCRIPTION

Figure 1:
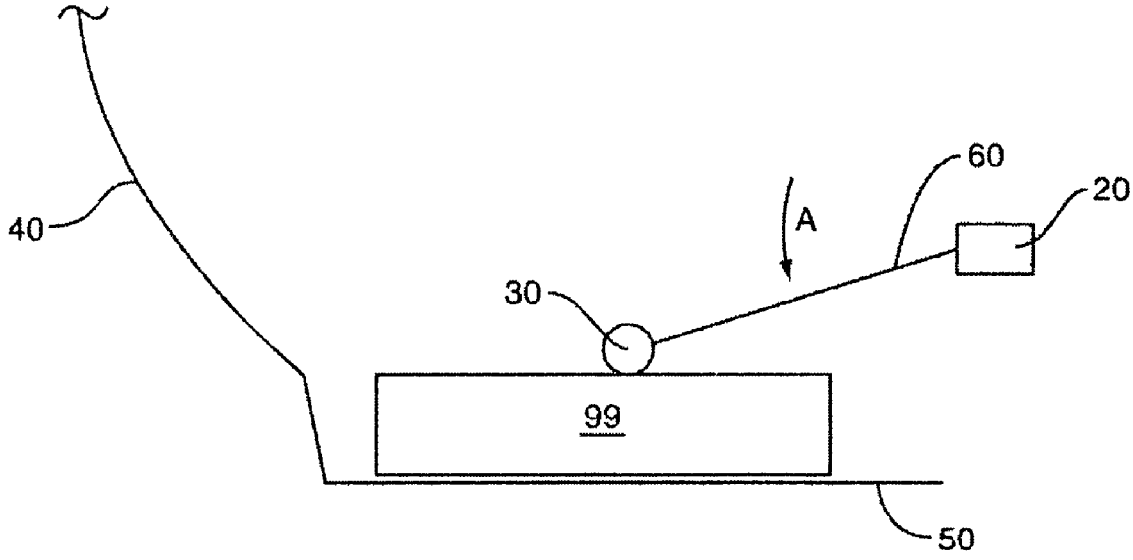
FIG. 1 is a schematic diagram of a clutch operatively connected to a pick arm according to one embodiment.

The present application is directed to media feed devices for feeding media sheets into a media path of an image forming apparatus. As illustrated schematically in FIG. 1, an arm 60 is pivotally positioned to locate a roller 30 in contact with a media stack 99 positioned on a support surface 50. The roller 30 is driven to rotate and move a top-most media sheet from the media stack 99 and into a media path 40. A clutch 20 is operatively connected to the arm 60. The clutch 20 allows for the arm 20 to move in the direction of arrow A towards the support surface 50 to maintain the roller 30 in contact with the top-most sheet as the media stack 99 is depleted. The clutch 20 also prevents or reduces an amount of pick arm movement away from the support surface 50.

Figure 2:
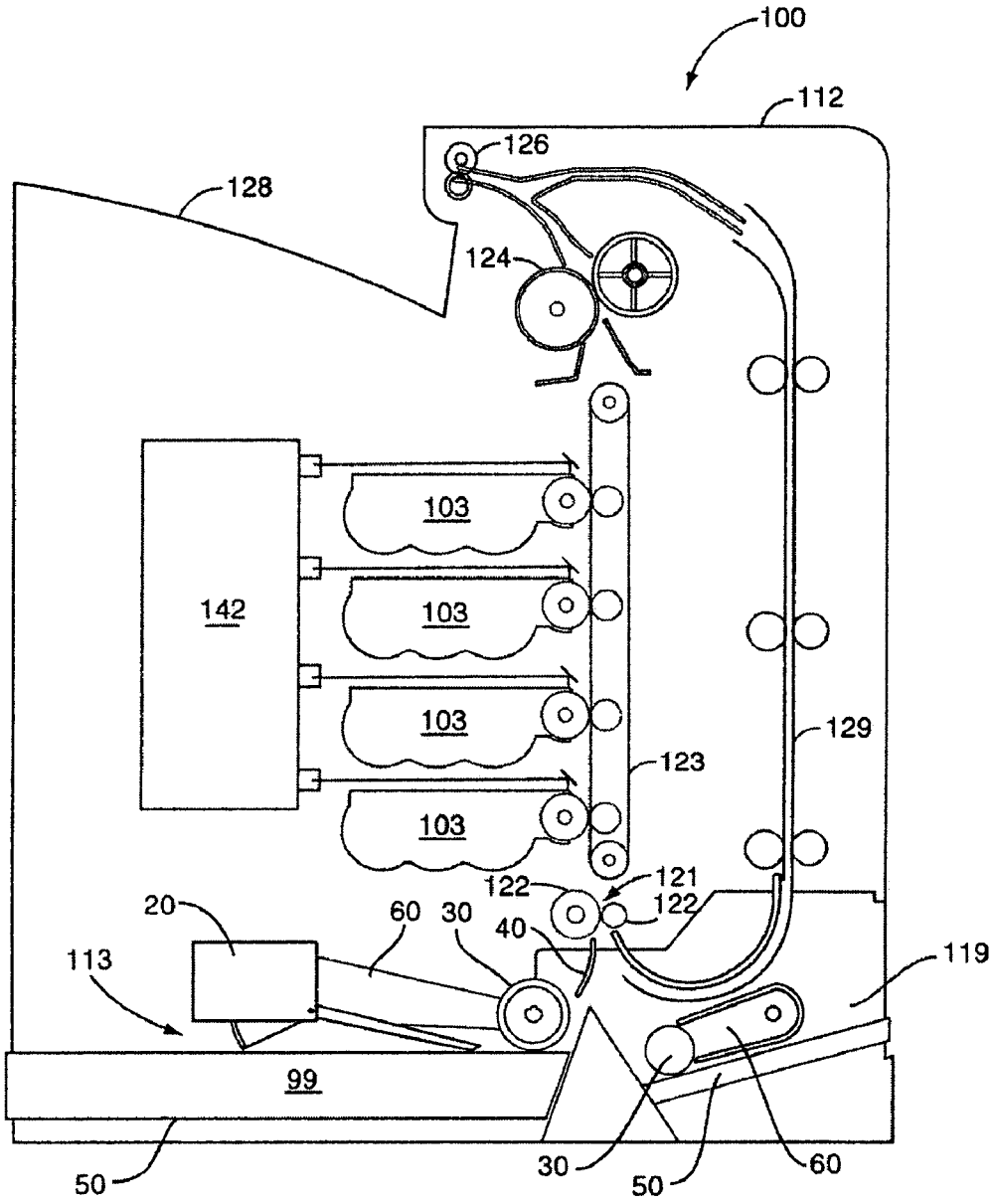
FIG. 2 is a schematic view of an image forming apparatus according to one embodiment.

To better understand the context of feeding media sheets, FIG. 2 includes one embodiment of an image forming apparatus 100. The image forming apparatus 100 comprises a main body 112 and an input area 113 with a support surface 50 for holding a stack 99 of media sheets. The pick arm 60 is positioned for the roller 30 to rest on the top-most sheet of the stack 99. As the media stack 99 is depleted, the location of the top-most sheet moves further downward towards the support surface 50. The pivoting arm 60 pivots downward with the roller 30 remaining in contact with the top-most media sheet in the stack 99.

Media sheets may also be input into the media path 40 through a multi-purpose feeder 119. The multi-purpose feeder 119 includes a support surface 50 that supports media sheets that are then introduced into the media path 40 by rotation of a roller 30 connected to a pick arm 60.

In use, a media sheet is moved from either the input area 113 or multi-purpose feeder 119 and moved into the media path 40. A registration nip 121 formed between rolls 122 align the media sheet prior to passing to a transport belt 123 and past a series of image forming stations 103. A print system 142 forms a latent image on a photoconductive member in each image forming station 103 to form a toner image. The toner image is then transferred from the image forming station 103 to the passing media sheet.

Color image forming devices typically include four image forming stations 103 for printing with cyan, magenta, yellow, and black toner to produce a four-color image on the media sheet. The transport belt 123 conveys the media sheet with the color image thereon towards a fuser 124, which fixes the color image on the media sheet. Exit rollers 126 either eject the print media to an output tray 128, or direct it into a duplex path 129 for printing on a second side of the media sheet. In the latter case, the exit rollers 26 may partially eject the print media and then reverse direction to invert the media sheet and direct it into the duplex path 129. A series of rollers in the duplex path 129 return the inverted print media to the primary media path for printing on the second side.

Figure 3:
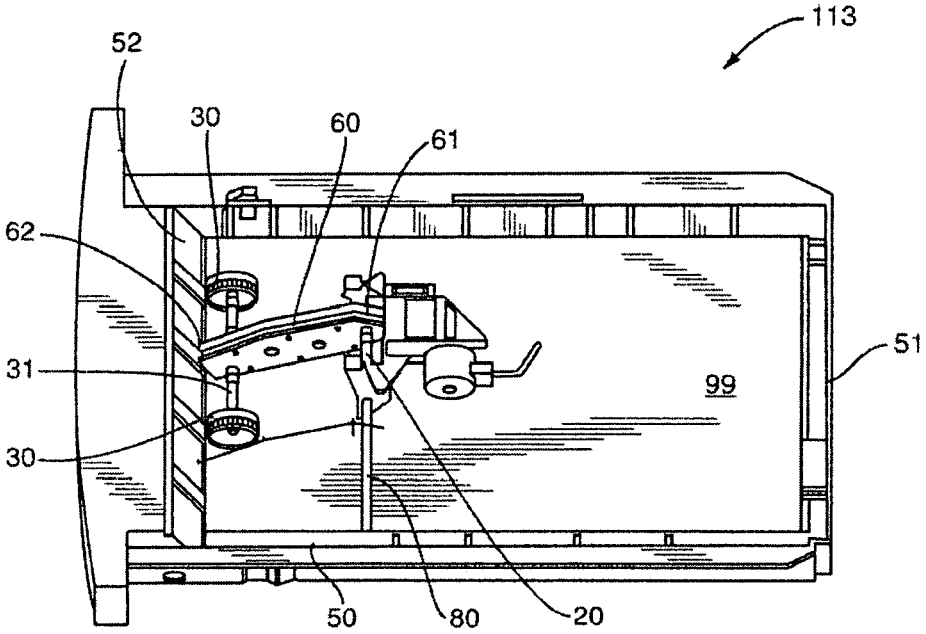
FIG. 3 is a perspective view of a media tray with a support surface, and a pick arm with a clutch according to one embodiment.

FIG. 3 illustrates a more detailed view of the elements of the input area 113. In this embodiment, the support surface 50 is part of an input tray 51 that is removable from the image forming device body 112. The input tray 51 is sized to receive the media stack 99 placed on the support surface 50. A ramp 52 is positioned at the end of the support surface 50 to direct the media sheets into the media path 40.

The arm 60 includes an elongated shape with a first end 61 and a second end 62. The arm 60 is pivotally attached to a drive shaft 80 at or in the proximity to the first end 61. The second end 62 is positioned towards the media stack 99. The roller 30 is positioned at or in proximity to the second end 62. In the embodiment of FIG. 3, a shaft 31 extends through the arm 60 towards the second end 62. A separate roller 30 is positioned on each end of the shaft 31 to contact against the top-most sheet in the media stack 99. A gear train (not illustrated) extends through the interior of the arm 60 and is powered to rotate the shaft 31 thereby rotating the rollers 30 and driving the top-most media sheet from the media stack 99. Embodiments of devices to feed media sheets within an image forming device are disclosed in U.S. Pat. Nos. 5,868,385 and 6,076,821 each incorporated herein by reference.

When the leading edge of the media sheet moves from the support surface 50 and is within the registration nip 121 in the media path 40, there is a tendency for the media sheet to lift the arm 60 upward away from the stack of media sheets. This lifting is caused because the rotational power to the rollers 30 is shut off and the rollers 30 remain in contact with the media sheet. The force of the registration nip 121 pulling the media sheet and the continued contact of the rollers 30 on the media sheet results in the arm 60 lifting upward. After the trailing edge of the media sheet moves beyond the rollers 30, gravity causes the arm 60 to move downward to again contact the next top-most sheet in the media stack 99. While the arm 60 is out of contact, the top-most sheet cannot be picked from the media stack 99 and moved into the media path 40. This reduces the number of media sheets that can be picked, and therefore reduces the output of the image forming apparatus 100.

The clutch 20 prevents or limits the amount of movement of the arm 60 in a direction away from the support surface 50 when the media sheet is in the control of the registration nip 121. This limits or eliminates the amount of time the roller 30 is out of contact with the top-most sheet thereby decreasing the time between picking sheets and thus increasing output.

Figure 4:
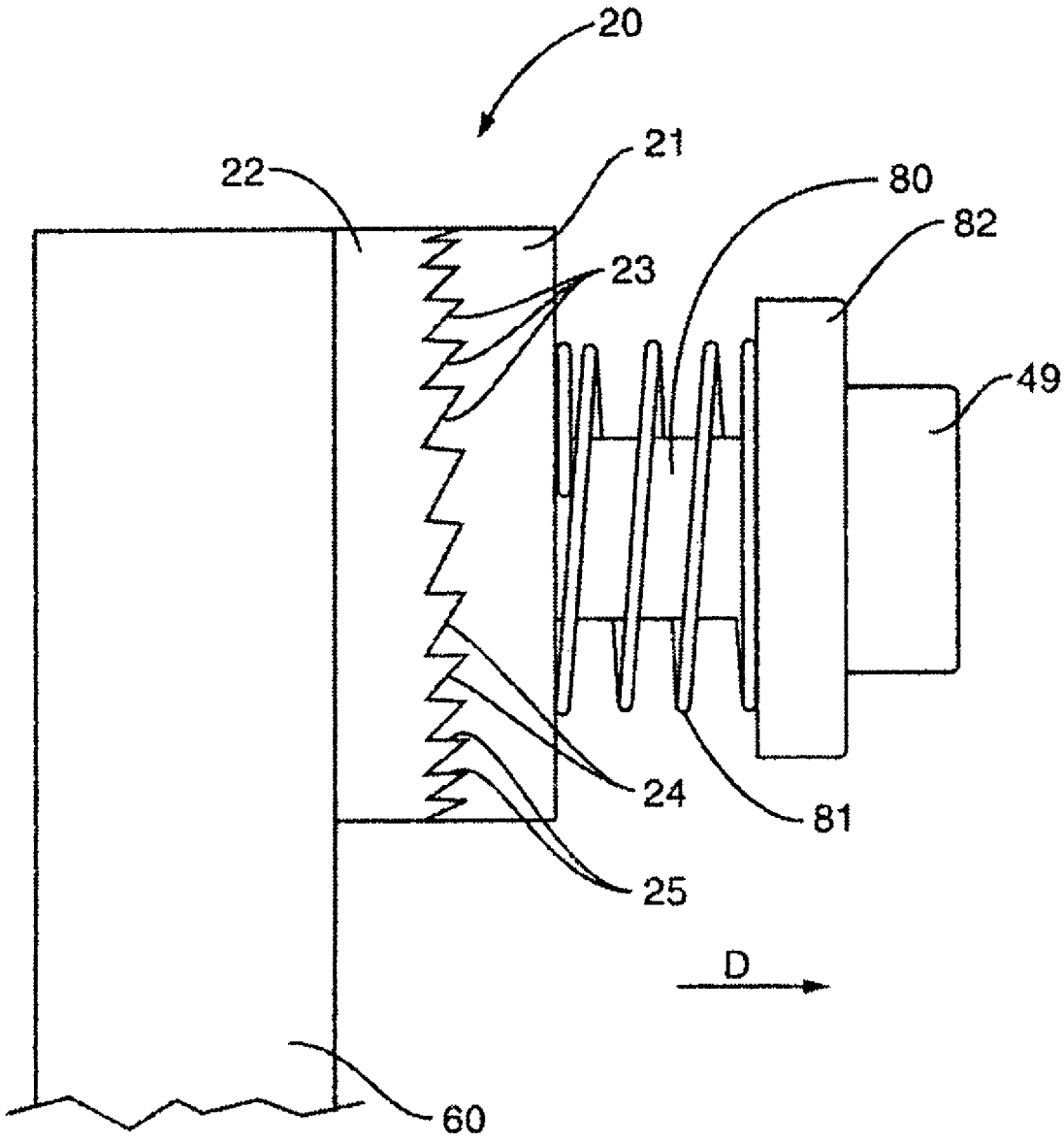
FIG. 4 is a side view of a clutch operatively connected to a pick arm according to one embodiment.

FIG. 4 illustrates one embodiment of a clutch 20 that is operatively connected to the arm 60. Clutch 20 includes a first section 21 that abuts against a second section 22. Each section 21, 22 includes teeth 23 that mesh together and include a first face 24 and a second face 25. The slope of the first faces 24 is less than the second faces 25. The first section 21 is operatively connected to the main body 112 of the device 100 in a manner to prevent rotation. The second section 22 is operatively connected to and moves with the arm 60. A biasing member 81 may be positioned between a collar 82 and the first section 21 to maintain engagement of the sections 21, 22. In one embodiment, each of the first and second sections include circular sectional shapes with the teeth 23 positioned on one of the sides.

Figure 5A:
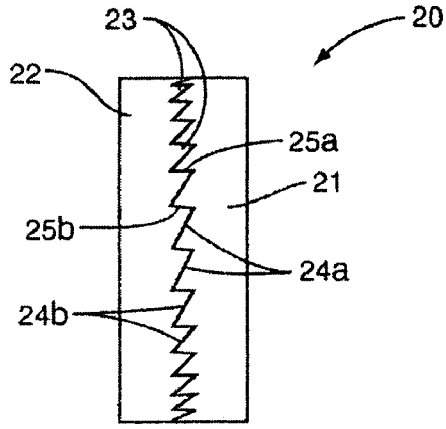
FIGS. 5A-5C are schematic side views of relative movement between first and second sections of a clutch according to one embodiment.
Figure 5B:
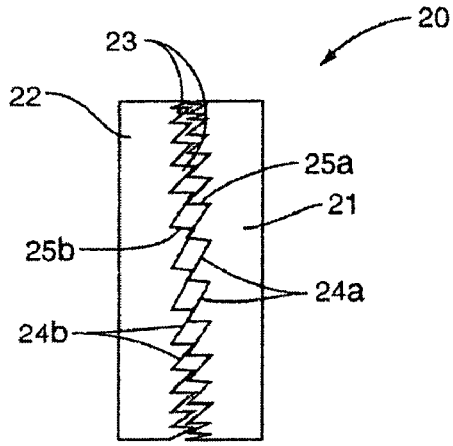
Figure 5C:
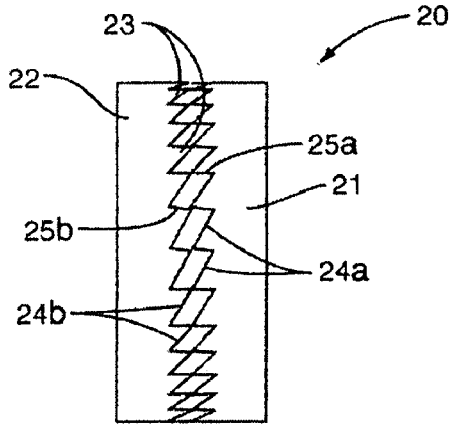

FIGS. 5A-5C illustrate the relative motion of the second section 22 relative to the first section 21 as the media stack is depleted. As illustrated in FIG. 5A, the teeth 23 are fully engaged with the majority of the length of the first section first faces 24*a* in contact along the length of the second section first faces 24*b*. Further, the first section second faces 25*a* are in contact with the second section second faces 25*b*. In the event a media sheet is pulled by the registration nip 121 while in this orientation, any upward movement is prevented because the second faces 25*a*, 25*b* are in contact.

FIG. 5B illustrates the relative positions of the sections 21, 22 after a first number of media sheets have been moved from the media stack 99. The angles of the first surfaces 24*a*, 24*b* provide for the second section 22 to slide against the first section 21 during depletion of the media stack 99. In one embodiment, the sliding movement is caused by the weight of the arm 60 that overcomes any friction between the first surfaces 24*a*, 24*b*. In one embodiment, the arm 60 is biased downwards by a biasing member (not illustrated) to overcome the friction. In both embodiments, the force is adequate to maintain the rollers(s) 30 on the arm 60 in contact with the top-most sheet.

The relative positions of the sections 21, 22 in FIG. 5B provide for a reduced amount of upward movement of the arm 60. The amount of upward movement is equal to the distance between the second faces 25*a*, 25*b*. The abrupt angle of the second faces 25*a*, 25*b* prevent further movement of second section 22 relative to the first section 21 in an upward direction and thereby prevent further upward movement of the arm 60.

FIG. 5C illustrates the relative positions of the sections 21, 22 after a greater number of media sheets have been moved from the media stack 99. The first faces 24*a*, 24*b* have continued to slide due to continued rotation of the second section 22. This movement results in a smaller amount of remaining contact between the first faces 24*a*, 24*b*. Likewise, the second faces 25*a*, 25*b* have moved a greater distance apart. Thus, the arm 60 may experience a greater amount of upward movement in the event a media sheet is picked and subsequently controlled by the registration nip 121. However, the upward movement is limited to the distance between the faces 25*a*, 25*b*.

At some point, the number of media sheets picked from the support surface 50 will cause a great enough amount of movement such that the first faces 24*a*, 24*b* slide past each other. When this occurs, the sections 21, 22 reset back to a position similar to that illustrated in FIG. 5A.

The length of the first faces 24*a*, 24*b* controls the amount of upward movement of the arm 60. A smaller length results in lesser upward movement. Conversely, a greater length results in a greater amount of possible upward movement.

Figure 6:
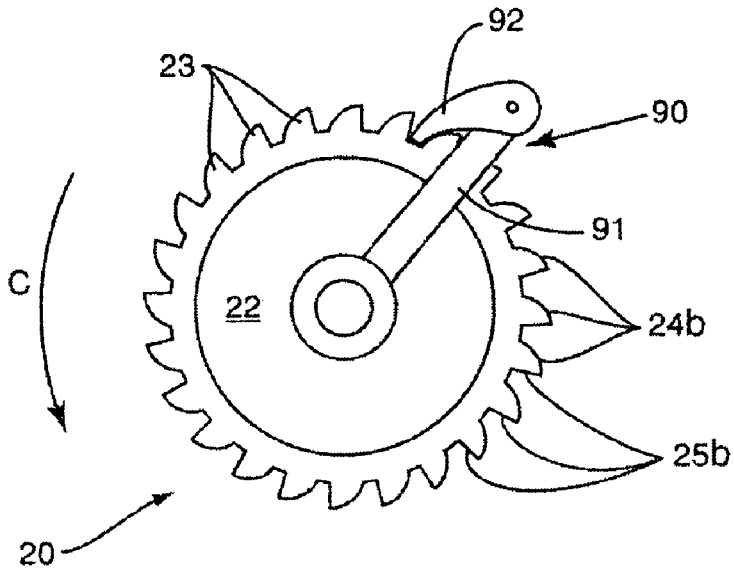
FIG. 6 is a side view of a clutch operatively connected to a pick arm according to one embodiment.

FIG. 6 illustrates another clutch 20 that limits or prevents upward movement of the arm 20. Clutch 20 includes a second section 22 with teeth 23 facing outward along a periphery. The second section 22 is operatively connected to the arm 60. A ratchet member 90 is positioned in proximity to the second section 22. Ratchet member 90 is operatively connected to the main body 112 in the input area 113 and includes an arm 91 with a pawl 92 at a distal end. The pawl 92 is sized to fit between the teeth 23. The pawl 92 is arranged at an angle relative to the teeth 23 to allow the first faces 24*b* to slide along the pawl 92 when the second section 22 rotates in the direction of arrow C. The amount of rotation in a second, opposite direction is limited by the pawl 92 contacting against the second faces 25*b*. The ratchet member 90 provides for the second section 22 to rotate downward in the direction of arrow C during depletion of the media stack 99 to allow the roller(s) 30 on the arm 60 to remain in contact with the top-most sheet. The amount of upward movement of the arm 60 is limited when the media sheet 99 moves into the control of the registration nip 121.

Figure 7:
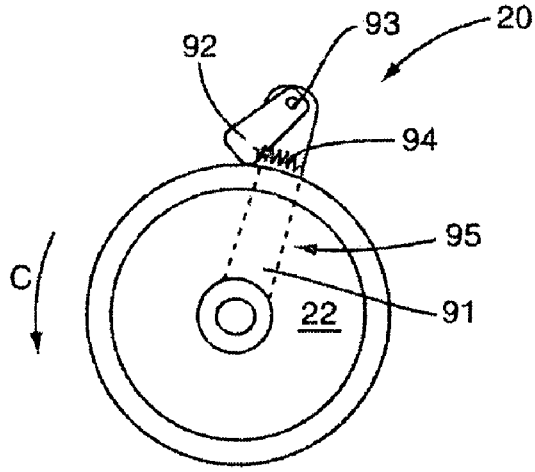
FIG. 7 is a side view of a clutch operatively connected to a pick arm according to one embodiment.

FIG. 7 illustrates another clutch 20 that includes the second section 22 with a relatively smooth peripheral surface. A friction brake 95 is positioned to engage the second section 22. Friction brake 95 includes an arm 91 with a brake 92 attached by a pivot 93 to a distal end. The arm 91 is operatively connected to the main body 112 in the input area 113. A biasing member 94 extends between the arm 91 and brake 92 to maintain the brake 92 in contact with the periphery of the second section 22. A length of the brake 92 is less than a distance between the pivot 93 and the periphery of the second section 22. This configuration provides for the second section 22 to rotate in the direction of arrow C during depletion of the media stack 99. Rotation in the opposite direction caused by the registration rollers is prevented or limited by the brake 92 rotating about the pivot 93 and locking against the periphery of the second section 22.

In one embodiment used with an input tray 51, the pick arm 60 lifts upward away from the support surface 50 when the input tray 51 is removed from the image forming device body 112. This usually occurs when the input tray 51 is removed to refill the media stack or change types or sizes of media sheets, or during jam clearance. In one embodiment as illustrated in FIG. 4, a lift mechanism 49 allows for the pick arm 60 to lift upward. The lift mechanism 49 is operatively connected to the first section 21 of the clutch 20. The lift mechanism 49 moves the first section 21 laterally in the direction of arrow D to disengage the teeth 23 between the first and second sections 21, 22. After disengagement, the arm 60 may be lifted upward away from the support surface 60 to allow removal of the input tray 51. Once the input tray 51 is returned, the lift mechanism 49 moves the first section 21 back into engagement with the second section 22. In one embodiment, the lift mechanism 49 is a solenoid. In another embodiment, the lift mechanism 49 is cam actuated.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. In one embodiment, the teeth 23 of the first and second sections 21, 22 include different shapes and/or sizes. The present embodiments are, therefore, to be considered in all respects as illustrative and not restrictive, and all changes coming within the meaning and equivalency range of the appended claims are intended to be embraced therein.

What is claimed is:

1. An assembly to move media sheets from a media stack within an image forming apparatus comprising:

a pivoting arm;

a roller attached to the arm to contact the media stack and rotate to move a top-most sheet from the media stack; and a clutch operatively connected to the arm to allow the arm to pivot in a first direction to maintain the roller positioned on a top of the media stack as the media stack is depleted and a height of the media stack is reduced, and reduce movement of the arm in a second direction beyond a predetermined amount, wherein the clutch comprises first and second sections that each include teeth, the teeth including a first face positioned at a lesser angle that slide across each other as the arm pivots in the first direction and a second face with a greater angle that prevents sliding movement and prevents the arm from pivoting in the second direction.

2. The assembly of claim 1, further comprising a biasing member to maintain engagement of the teeth between the first and second sections.

3. The assembly of claim 1, wherein the clutch includes a first section and a second section operatively connected to the arm, the first section being connected to the image forming apparatus to remain stationary as the second section rotates as the arm pivots in the first direction.

4. The assembly of claim 1, further comprising a lift mechanism operatively connected to the clutch to disengage first and second sections of the clutch to allow the arm to freely move in the second direction.

5. An assembly to move media sheets from a media stack within an image forming apparatus comprising:

a pivoting arm;

a roller attached to the arm to contact the media stack and rotate to move a top-most sheet from the media stack; and a clutch operatively connected to the arm to allow the arm to pivot in a first direction to maintain the roller positioned on a top of the media stack as the media stack is depleted and a height of the media stack is reduced, and reduce movement of the arm in a second direction beyond a predetermined amount, wherein the clutch includes a toothed wheel operatively connected to the pivot arm with a plurality of teeth positioned about a periphery of the wheel, each tooth including a first and a second face with the first face being aligned at a lesser angle to the periphery than the second face, the clutch further including a ratchet mechanism with a brake that contacts against the teeth, the brake positioned at an angle relative to the periphery of the wheel to slide across the first faces as the wheel rotates in a first direction, and contact against a second face of one of the plurality of teeth to prevent the rotation of the wheel in a second direction.

6. The assembly of claim 5, wherein the ratchet mechanism further includes an arm with a first end aligned with a center point of the wheel and a second end positioned away from the center point beyond the periphery of the wheel, the brake being connected to the arm at the second end.

7. An assembly to move media sheets from a media stack within an image forming apparatus comprising:

a pivoting arm;

a roller attached to the arm to contact the media stack and rotate to move a top-most sheet from the media stack; and a clutch operatively connected to the arm to allow the arm to pivot in a first direction to maintain the roller positioned on a top of the media stack as the media stack is depleted and a height of the media stack is reduced, and reduce movement of the arm in a second direction beyond a predetermined amount, wherein the clutch includes a wheel operatively connected to the pivot arm and including a substantially smooth periphery, the clutch further including a friction brake mechanism with a brake pivotally attached to a support member at a pivot, the pivot being positioned away from the wheel and the brake positioned to contact the periphery of the wheel.

8. The assembly of claim 7, wherein the friction brake mechanism further includes a biasing member that extends between the support member and the brake to bias the brake into contact with the periphery of the wheel.

9. An assembly to move media sheets from a media stack within an image forming apparatus comprising:

an arm;

a roller attached to the arm to contact the media stack and rotate to move a top-most sheet from the media stack; and a clutch operatively connected to the arm and including a first section with first set of teeth and a second section with a second set of teeth, each of the teeth including a first face aligned at a first angle relative to the first and second sections respectively and a second face aligned at a second angle relative to the first and second sections respectively;

the first faces of the teeth sliding across each other when the arm pivots in a first direction to maintain the roller positioned on a top of the media stack as the media stack is depleted and a height of the media stack is reduced;

one of the second faces of each of the teeth contacting against each other when the arm pivots in a second direction to prevent further movement in the second direction.

10. The assembly of claim 9, wherein each of the first and second sections includes a circular sectional shape with the teeth positioned on one side.

11. The assembly of claim 9, further comprising a biasing member to maintain engagement of the first and second sections.

12. The assembly of claim 9, wherein the clutch is positioned vertically above an input tray within the image forming apparatus.

13. The assembly of claim 9, further comprising a lift mechanism operatively connected to the clutch to disengage the first and second sections to allow the arm to freely move in the second direction.

14. The assembly of claim 9, wherein a shape and size of each of the teeth is substantially the same.

15. A method of moving media sheets from a media stack within an image forming apparatus comprising:

contacting a roller at an end of an arm against a top of a media stack;

rotating the roller and moving a top-most sheet from the media stack into a media path;

pivoting the arm in a first direction and maintaining the roller in contact with the top of the media stack as a height of the stack is depleted;

sliding a first element of a clutch against a second element of the clutch as the arm pivots in the first direction, the first element being operatively connected to the first section; and locking the first element of the clutch with the second element of the clutch when the arm pivots in a second direction and limiting the roller from moving away from the top-most sheet, wherein the step of sliding the first element of the clutch against the second element of the clutch as the arm pivots in the first direction comprises sliding first faces of teeth on the first and second elements against each other.

16. The method of claim l5, wherein the step of locking the first element of the clutch with the second element of the clutch when the arm pivots in the second direction comprises contacting second faces of the teeth on the first and second elements against each other.

17. A method of moving media sheets from a media stack within an image forming apparatus comprising:

contacting a roller at an end of an arm against a top of a media stack;

rotating the roller and moving a top-most sheet from the media stack into a media path;

pivoting the arm in a first direction and maintaining the roller in contact with the top of the media stack as a height of the stack is depleted;

sliding a first element of a clutch against a second element of the clutch as the arm pivots in the first direction, the first element being operatively connected to the first section; and locking the first element of the clutch with the second element of the clutch when the arm pivots in a second direction and limiting the roller from moving away from the top-most sheet, wherein the step of sliding the first element of the clutch against the second element of the clutch as the arm pivots in the first direction comprises sliding a brake on a ratchet mechanism of the first element across first faces of teeth on the second element and the step of locking the first element of the clutch with the second element of the clutch when the arm pivots in the second direction comprises contacting the brake against a second face of one of the teeth on the second element.

18. A method of moving media sheets from a media stack within an image forming apparatus comprising:

contacting a roller at an end of an arm against a top of a media stack;

rotating the roller and moving a top-most sheet from the media stack into a media path;

pivoting the arm in a first direction and maintaining the roller in contact with the top of the media stack as a height of the stack is depleted;

sliding a first element of a clutch against a second element of the clutch as the arm pivots in the first direction, the first element being operatively connected to the first section; and locking the first element of the clutch with the second element of the clutch when the arm pivots in a second direction and limiting the roller from moving away from the top-most sheet, wherein the step of sliding the first element of the clutch against the second element of the clutch as the arm pivots in the first direction comprises sliding a brake on a friction brake of the first element across a periphery of the second element and the step of locking the first element of the clutch with the second element of the clutch when the arm pivots in the second direction comprises wedging the brake against the periphery of the second element.

* * * * *